US012043978B1

(12) United States Patent
Leinert

(10) Patent No.: US 12,043,978 B1
(45) Date of Patent: Jul. 23, 2024

(54) BUCKET LIFTING EXTENSION DEVICE

(71) Applicant: William R. Leinert, Newtown, CT (US)

(72) Inventor: William R. Leinert, Newtown, CT (US)

( * ) Notice: Subject to any disclaimer, the term of this patent is extended or adjusted under 35 U.S.C. 154(b) by 0 days.

(21) Appl. No.: 18/223,613

(22) Filed: Jul. 19, 2023

(51) Int. Cl.
*E02F 3/96* (2006.01)

(52) U.S. Cl.
CPC ..... *E02F 3/962* (2013.01)

(58) Field of Classification Search
CPC ..... E02F 3/962
See application file for complete search history.

(56) References Cited

U.S. PATENT DOCUMENTS 2,085,996 A * 7/1937 Phillips ..... E01H 5/066 37/270
3,938,680 A * 2/1976 Grimes ..... E02F 3/401 37/409
3,941,262 A 3/1976 Moser et al.
4,125,952 A * 11/1978 Jennings ..... E02F 3/962 37/405
4,254,564 A * 3/1981 Rath ..... E01H 5/062 37/283
4,261,115 A * 4/1981 Chittenden ..... E01H 5/061 172/701.3
4,422,819 A * 12/1983 Guest ..... E02F 3/401 37/406
4,566,844 A * 1/1986 Campin ..... E02F 3/404 37/409
4,890,400 A * 1/1990 Long ..... E02F 3/7613 37/409
5,160,034 A * 11/1992 Potter ..... B07B 1/46 209/326
5,596,825 A * 1/1997 Von Schalscha ..... E02F 3/962 172/701.3
5,611,157 A * 3/1997 Ferreira ..... E02F 9/2883 37/449
5,775,013 A * 7/1998 Von Schalscha ..... E02F 3/962 172/701.3
5,908,252 A 6/1999 Harada et al.
6,113,308 A * 9/2000 Johnson ..... E01C 23/0913 404/74
6,125,559 A * 10/2000 Mullenhour ..... E01H 5/062 37/232

(Continued)

*Primary Examiner* — Jessica H Lutz
(74) *Attorney, Agent, or Firm* — Cramer Patent & Design PLLC; Aaron R. Cramer

(57) ABSTRACT

The bucket lifting extension device may comprise a pair of mounting blocks and a bucket extension. The bucket lifting extension device may be an attachment for a bucket of a piece of equipment. As non-limiting examples, the piece of equipment may be a front end loader such as a skid steer loader or a tractor. The bucket extension may enlarge the bottom of the bucket such that the bucket may easily lift bulky items. The pair of mounting blocks may couple to a bucket rear wall in order to retain the bucket extension on the bucket. The bucket extension may slide into a gap located between the pair of mounting blocks and the bucket rear wall. The bucket extension may be detachable by removing capture nuts, pivoting hinges located on the pair of mounting blocks, and sliding the bucket extension out from under the pair of mounting blocks.

1 Claim, 6 Drawing Sheets

(56) References Cited

U.S. PATENT DOCUMENTS

| | | | | |
|---|---|---|---|---|
| 6,167,642 | B1 * | 1/2001 | Nardini | E02F 3/962 37/903 |
| 6,375,405 | B1 | 4/2002 | Kallevig | |
| 7,351,028 | B2 | 4/2008 | Potter et al. | |
| 7,429,159 | B2 * | 9/2008 | Priest | E02F 3/962 37/903 |
| 8,006,414 | B2 | 8/2011 | Leonard | |
| 8,157,473 | B2 * | 4/2012 | Johnson | E02F 3/3414 404/94 |
| 8,689,898 | B2 | 4/2014 | Benesch | |
| 9,057,179 | B1 | 6/2015 | Kubas | |
| 10,024,026 | B2 | 7/2018 | Uchijima et al. | |
| 10,352,019 | B2 | 7/2019 | Boyd et al. | |
| 10,358,789 | B2 | 7/2019 | Hyder | |
| 10,767,339 | B2 | 9/2020 | Wagner et al. | |
| 10,894,497 | B2 | 1/2021 | Urbanick et al. | |
| 11,078,644 | B2 | 8/2021 | Cantu et al. | |
| 11,261,579 | B1 * | 3/2022 | Willis | E02F 5/025 |
| 11,346,074 | B2 | 5/2022 | Babl et al. | |
| 2005/0111955 | A1 * | 5/2005 | Truan | E01H 1/02 414/723 |
| 2014/0317968 | A1 * | 10/2014 | Payne | B66F 9/065 37/405 |
| 2020/0087885 | A1 | 3/2020 | Smith | |

* cited by examiner

BUCKET LIFTING EXTENSION DEVICE

RELATED APPLICATIONS

Non-applicable.

FIELD OF THE INVENTION

The current invention pertains, in a broad sense, to a lifting device and, in particular, to a bucket lifting extension device for a front end loader.

BACKGROUND OF THE INVENTION

A bucket lifting extension device is a bucket attachment that is very useful and effective, and its primary purpose is to improve the lifting capabilities of equipment buckets. It is made up of a couple of mounting blocks and a bucket extension, which, when combined, provide a solution that is simple to use when it comes to the manipulation of large goods. The bucket lifting extension device is a specialized attachment that can be added on to a variety of different kinds of machinery, such as front-end loaders like skid steer loaders and tractors.

The major purpose of the bucket extension is to widen the bottom of the bucket so that it can lift bulkier goods more efficiently. This will be accomplished by the bucket being extended. This function is particularly helpful when working with huge or oddly shaped things, which may provide issues for buckets that are more traditionally used. When workers make use of the bucket extension, they are able to simply manipulate and move such goods without the need for extra equipment or a significant amount of additional physical labor.

The device offers mounting blocks which comes in pairs, and each one plays an important part in the overall stability and security of the attachment. These mounting blocks are made to couple with the back wall of the bucket, which serves the purpose of efficiently maintaining the bucket extension in situ while lifting activities are being performed. During operation, the user is afforded a higher level of protection thanks to the dependable attachment mechanism, which prevents the bucket extension from being accidentally detached and keeps it securely in place.

The steps involved in putting in and taking out the bucket lifting extension device have both been reduced for your convenience. The bucket extension may be quickly and simply attached by sliding into a space that is positioned between a pair of mounting blocks and the bucket's rear wall. This makes the connection process fast and easy. To detach the bucket extension, one must first remove the capturing nuts, then swivel the hinges that are attached to the mounting blocks, and then slide the extension out from beneath the mounting blocks. Because of its intuitive design, this piece of machinery may be rapidly adapted to meet a variety of lifting needs, and its connection can be removed when it is no longer required.

In conclusion, the bucket lifting extension device attachment is an efficient means of increasing the lifting capacities of equipment buckets, making it a valuable addition to the market. It makes the handling of large things much easier, increases efficiency, and expands the adaptability of front-end loaders and tractors thanks to the bucket extension and sturdy mounting blocks that it comes equipped with. Whether it is used in construction, agriculture, or any number of other sectors, the bucket lifting extension device proves to be an invaluable addition to equipment, significantly improving both the efficiency of operations and the output of products.

SUMMARY OF THE INVENTION

Embodiments of the present disclosure may include an bucket lifting extension device, including a pair of mounting blocks coupled to a bucket rear wall in order to retain the bucket extension on a bucket. Embodiments may also include a bucket extension enlarging a bottom of the bucket such that the bucket easily lifts bulky items, the bucket extension may include the bucket extension bottom wall and bucket extension side walls.

Embodiments may also include a left mounting block coupled to a left side of the bucket and a right mounting block coupled to the right side of the bucket. Embodiments may also include a block retention post projecting from the rear of one of the individual mounting blocks such that one of the mounting blocks may be coupled to the bucket. Embodiments may also include a front surface of each one of the mounting blocks having a hinge.

In some embodiments, the pair of mounting blocks may be coupled to an interior of the bucket on the bucket rear wall. In some embodiments, the pair of mounting blocks may be elevated above a bucket bottom wall such that a gap exists beneath both the left mounting block and the right mounting block. In some embodiments, the bucket extension slides into a gap located between the pair of mounting blocks and the bucket rear wall.

Embodiments may also include a height of the gap may be at least a thickness of a bucket extension bottom wall such that the bucket extension bottom wall slides into the gap. In some embodiments, the bucket extension may be detachable by removing capture nuts, pivoting hinges located on the pair of mounting blocks, and sliding the bucket extension out from under the pair of mounting blocks.

In some embodiments, the bucket extension detachably couples to the bucket such that the bucket may be enlarged. In some embodiments, the left mounting block and the right mounting block may be positioned at an equal height above the bucket bottom wall. In some embodiments, the left mounting block may be a rectangular cuboid.

In some embodiments, the right mounting block may be a rectangular cuboid. In some embodiments, the block retention post passes through one of a pair of block mounting apertures located on the bucket rear wall. In some embodiments, the block retention post may be threaded such that a retention nut and a retention lock washer screwed onto the block retention post from the rear of the bucket to hold one of the mounting blocks in place on the bucket.

In some embodiments, the bucket lifting extension device, according to may include a plurality of block mounting apertures having a plurality of left block mounting aperture and a plurality of right block mounting aperture. Embodiments may also include a hinge top half may be coupled to the individual mounting block with a hinge pin at the bottom of the individual mounting block.

In some embodiments, the hinge pin may be horizontally oriented such that a hinge bottom half extends forward horizontally in front of the individual mounting block and pivots up to a vertical position that may be parallel to the front of one of the mounting blocks. In some embodiments, the hinge bottom half pivots relative to the hinge top half at the hinge pin.

In some embodiments, the hinge bottom half pivots down such that one of a pair of block capture posts located on the bucket extension bottom wall passes through the hinge bottom aperture to hold the bucket extension in place. In some embodiments, the bucket extension bottom wall may include the pair of block capture posts. In some embodiments, the bucket extension bottom wall may be a horizontally-oriented plate that lies parallel to the bucket bottom wall.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
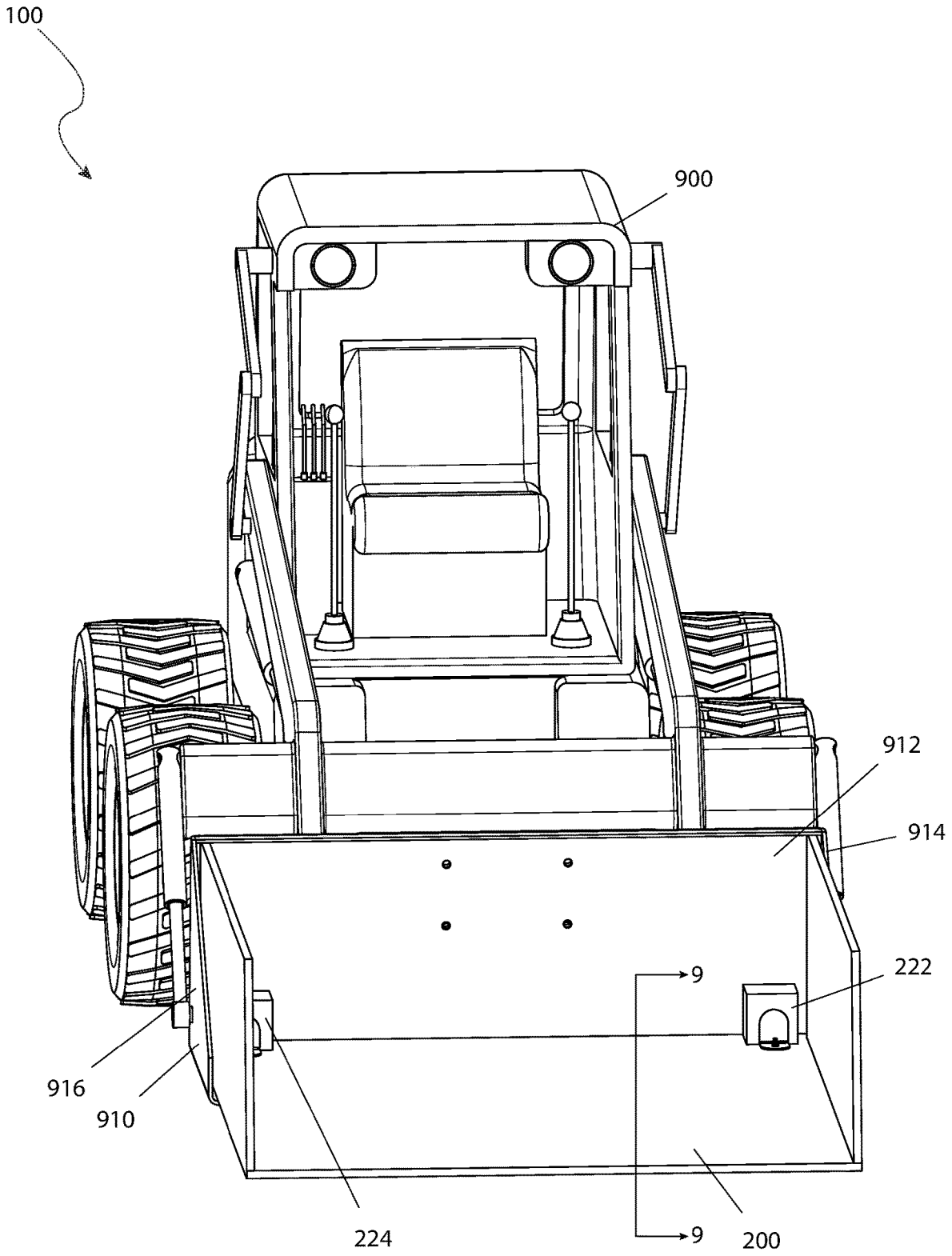
FIG. 1 is an in-use view of a bucket lifting extension device, according to an embodiment of the present device.
Figure 2:
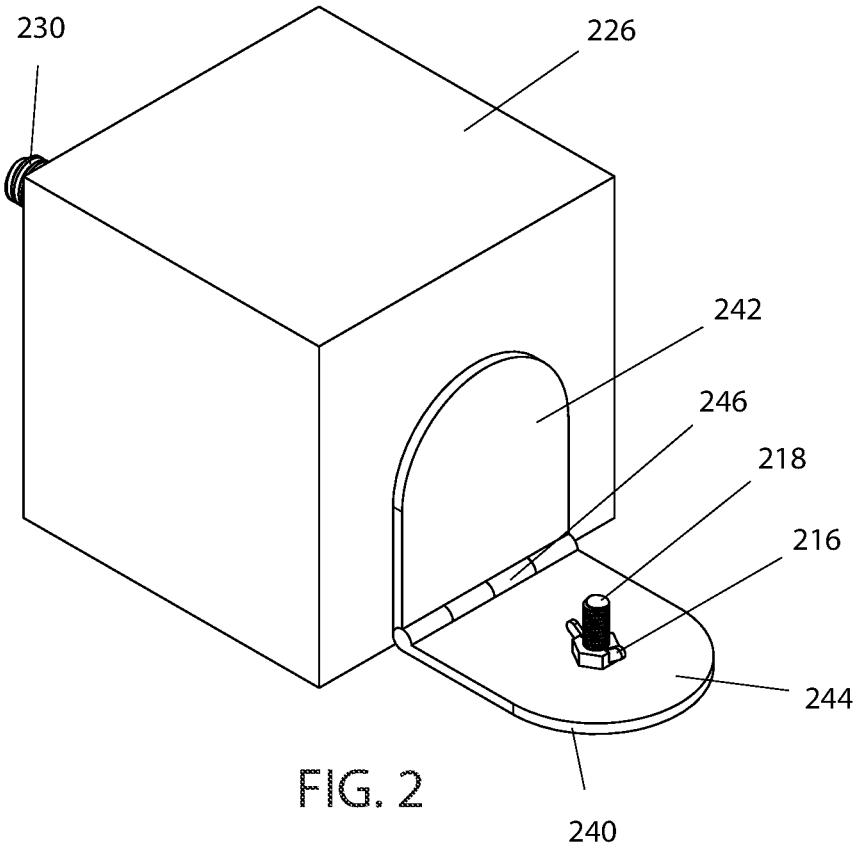
FIG. 2 is an isometric view of an individual mounting block, according to an embodiment of the present device.
Figure 3:
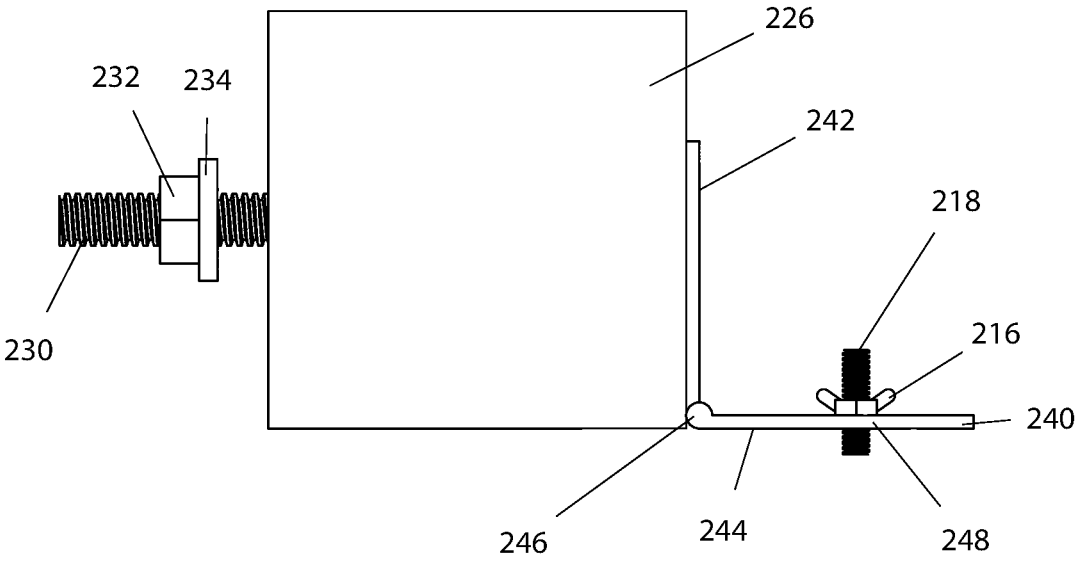
FIG. 3 is a side view of an individual mounting block, according to an embodiment of the present device.
Figure 4:
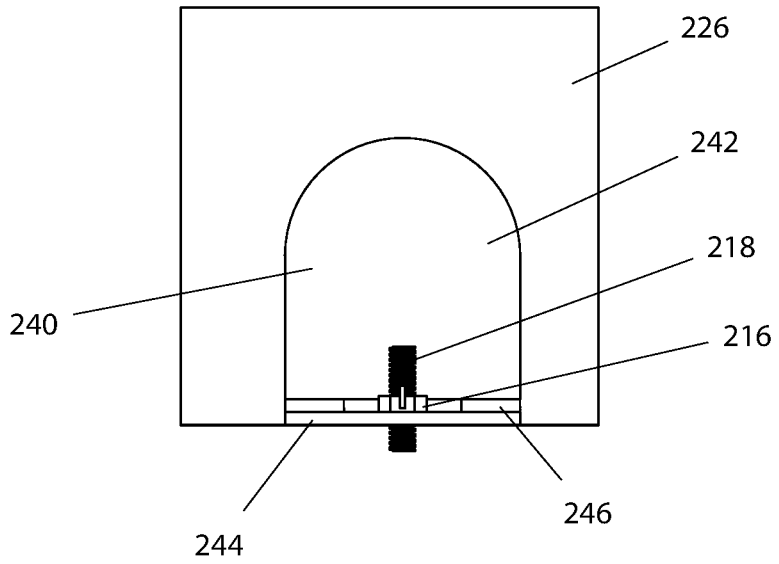
FIG. 4 is a front view of an individual mounting block, according to an embodiment of the present device.
Figure 5:
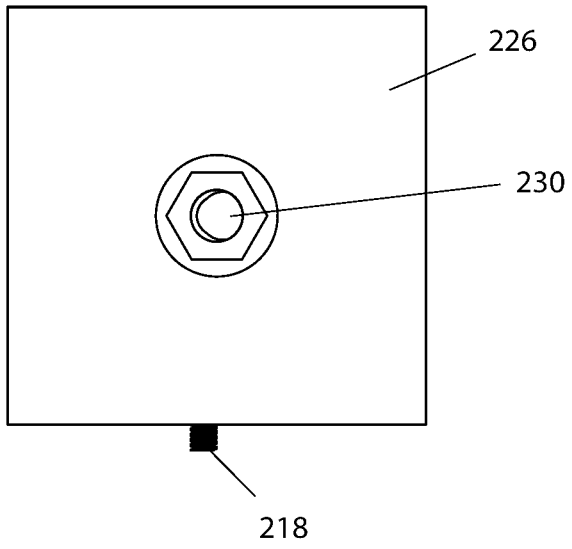
FIG. 5 is a rear view of an individual mounting block, according to an embodiment of the present device.
Figure 6:
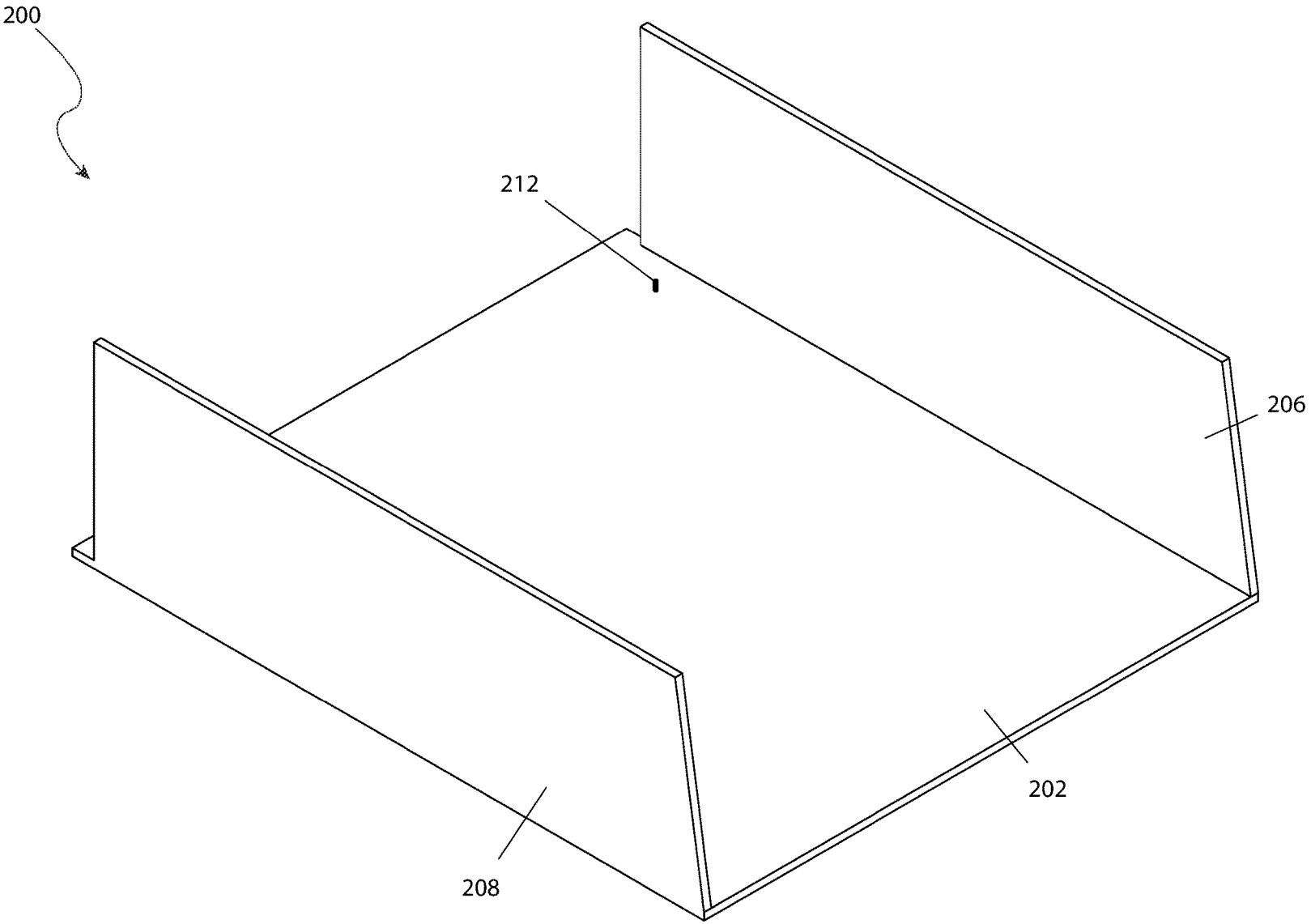
FIG. 6 is an isometric view of a bucket extension, according to an embodiment of the present device.
Figure 7:
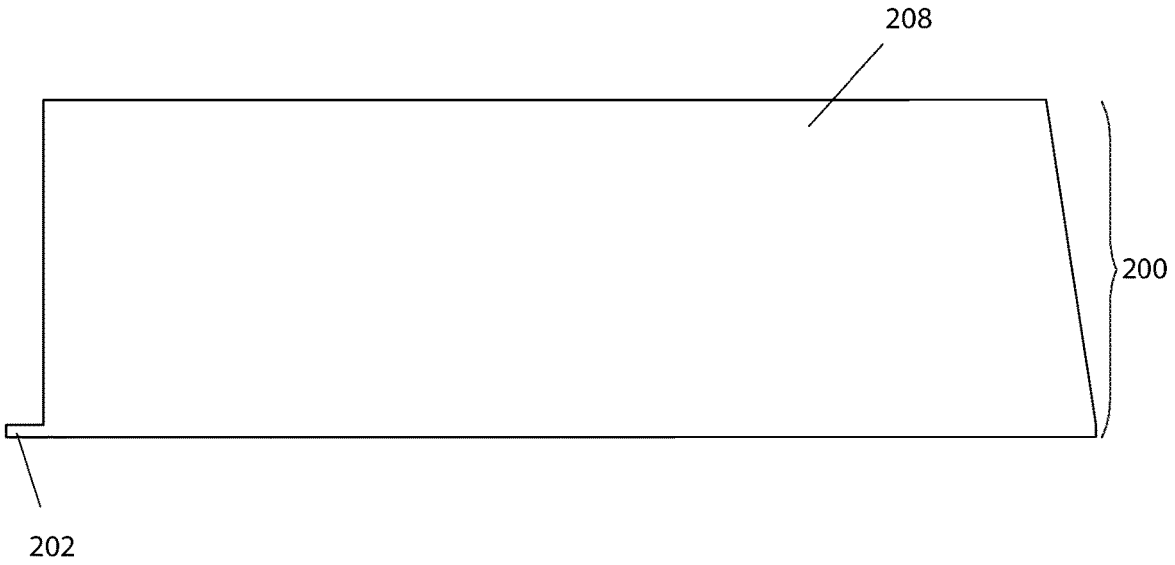
FIG. 7 is a side view of a bucket extension, according to an embodiment of the present device.
Figure 8:
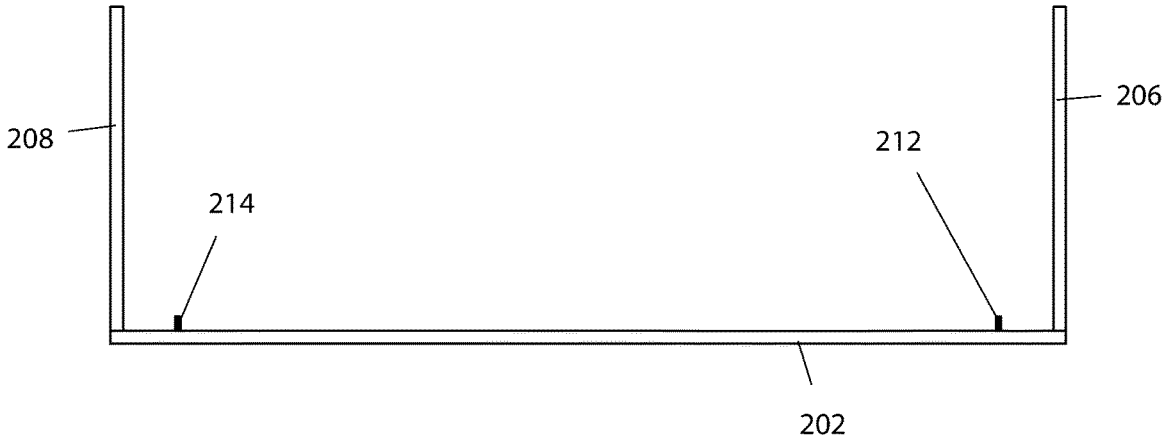
FIG. 8 is a front view of a bucket extension, according to an embodiment of the present device.
Figure 9:
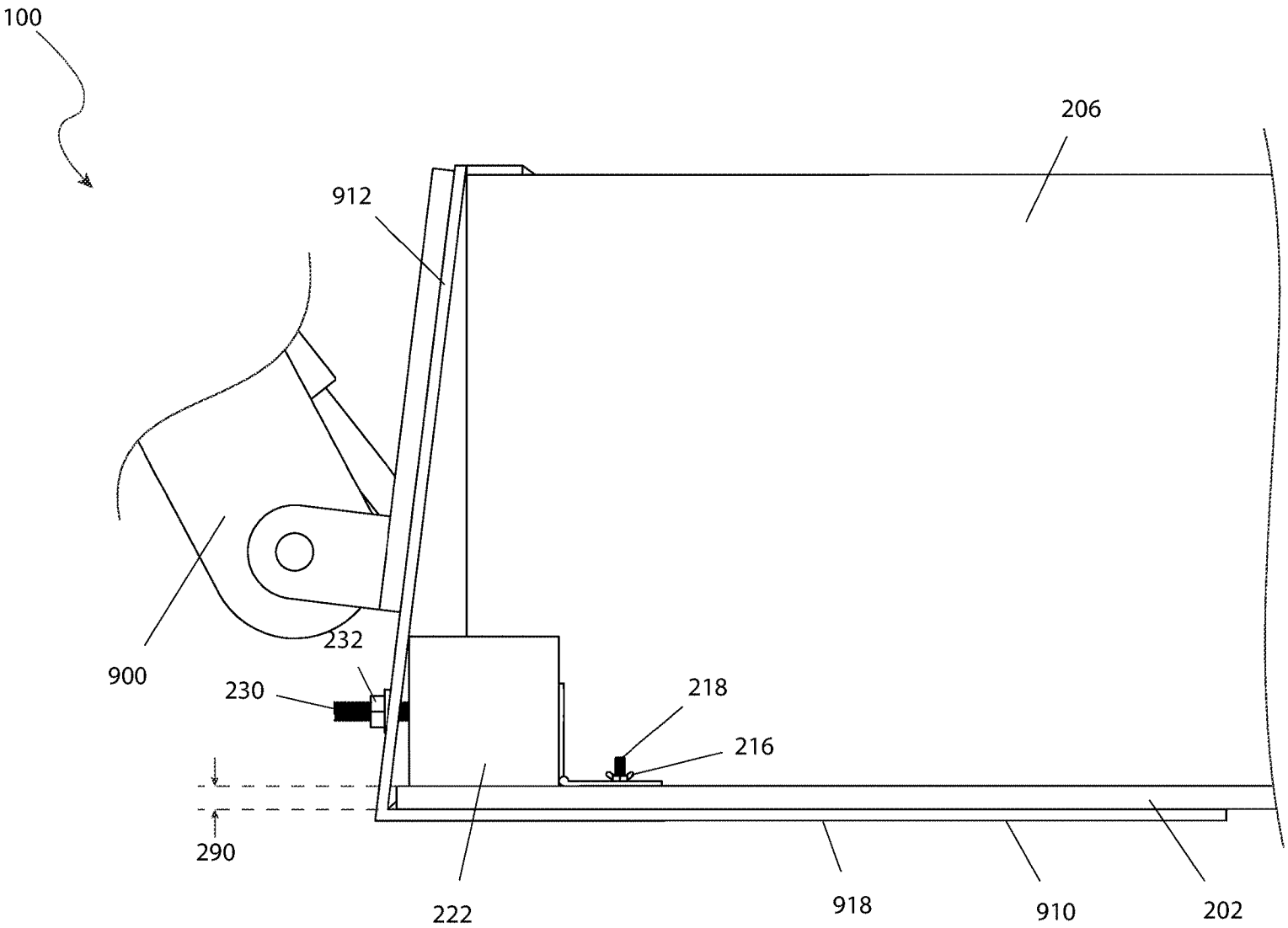
FIG. 9 is a cross-sectional view of an bucket lifting extension device, according to an embodiment of the present device, across Line 9-9 as shown in FIG. 1.

100 bucket lifting extension device
200 bucket extension
202 bucket extension bottom wall
206 bucket extension left side wall
208 bucket extension right side wall
212 left block capture post
214 right block capture post
216 capture nut
218 individual block capture post
222 left mounting block
224 right mounting block
226 individual mounting block
230 block retention post
232 retention nut
234 retention lock washer
240 hinge
242 hinge top half
244 hinge bottom half
246 hinge pin
248 hinge bottom aperture
290 gap
900 piece of equipment
910 bucket
912 bucket rear wall
914 bucket left side wall
916 bucket right side wall
918 bucket bottom wall

Description of the Device

The present device is directed to an bucket lifting extension device (herein described as the "device") 100. The bucket lifting extension device 100 may comprise a pair of mounting blocks and a bucket extension 200. The bucket lifting extension device 100 may be an attachment for a bucket 910 of a piece of equipment 900. As non-limiting examples, the piece of equipment 900 may be a front end loader such as a skid steer loader or a tractor. The bucket extension 200 may enlarge the bottom of the bucket 910 such that the bucket 910 may easily lift bulky items. As non-limiting examples, bulky items may comprise wood, mulch, construction materials, and farming materials. The pair of mounting blocks may couple to a bucket rear wall 912 in order to retain the bucket extension 200 on the bucket 910. The bucket extension 200 may slide into a gap 290 located between the pair of mounting blocks and the bucket rear wall 912. The bucket extension 200 may be detachable by removing capture nuts 216, pivoting hinges 240 located on the pair of mounting blocks, and sliding the bucket extension 200 out from under the pair of mounting blocks.

The pair of mounting blocks may be coupled to the interior of the bucket 910 on the bucket rear wall 912. A left mounting block 222 may be coupled to the left side of the bucket 910 and a right mounting block 224 may be coupled to the right side of the bucket 910. In some embodiments, the left mounting block 222 may be positioned adjacent to a bucket left side wall 914 and the right mounting block 224 may be positioned adjacent to a bucket right side wall 916. The pair of mounting blocks may be elevated above a bucket bottom wall 918 such that the gap 290 exists beneath both the left mounting block 222 and the right mounting block 224. The left mounting block 222 and the right mounting block 224 may be positioned at the same height above the bucket bottom wall 918. The height of the gap 290 may be at least the thickness of a bucket extension bottom wall 202 such that the bucket extension bottom wall 202 may slide into the gap 290.

An individual mounting block 226 selected from the left mounting block 222 and the right mounting block 224 may be a rectangular cuboid. The individual mounting block 226 may be oriented such that a bottom surface of the individual mounting block 226 is parallel to the bucket bottom wall 918. A block retention post 230 may project from the rear of the individual mounting block 226 such that the individual mounting block 226 may be coupled to the bucket 910. Specifically, the block retention post 230 may pass through one of a pair of block mounting apertures located on the bucket rear wall 912. The block retention post 230 may be threaded such that a retention nut 232 and a retention lock washer 234 screwed onto the block retention post 230 from the rear of the bucket 910 may hold the individual mounting block 226 in place on the bucket 910. The pair of block mounting apertures may comprise a left block mounting aperture and a right block mounting aperture. The left block mounting aperture may be located on the left side of the bucket 910 and the right block mounting aperture may be located on the right side of the bucket 910.

The front surface of the individual mounting block 226 may comprise the hinge 240. A hinge top half 242 may be coupled to the individual mounting block 226 with a hinge pin 246 at the bottom of the individual mounting block 226. The hinge pin 246 may be horizontally oriented such that a hinge bottom half 244 may extend forward horizontally in front of the individual mounting block 226 and may pivot up to a vertical position that is parallel to the front of the individual mounting block 226. The hinge bottom half 244 may pivot relative to the hinge top half 242 at the hinge pin 246.

The hinge bottom half 244 may comprise a hinge bottom aperture 248. The hinge bottom half 244 may pivot down such that one (1) of a pair of block capture posts located on the bucket extension bottom wall 202 may pass through the hinge bottom aperture 248 to hold the bucket extension 200 in place.

The bucket extension 200 may comprise the bucket extension bottom wall 202 and bucket extension side walls. The bucket extension 200 may detachably couple to the bucket 910 such that the bucket 910 may be enlarged.

The bucket extension bottom wall 202 may be a horizontally-oriented plate that may lie parallel to the bucket bottom wall 918. The bucket extension side walls may be vertically-oriented plates that may be coupled to the lateral edges of the bucket extension bottom wall 202 to form a U-shaped structure. The bucket extension side walls may comprise a bucket extension left side wall 206 and a bucket extension right side wall 208. The bucket extension side walls may prevent materials from falling off of the bucket extension 200 to the sides. The bucket extension left side wall 206 may be located on the left side of the bucket extension 200 and the bucket extension right side wall 208 may be located on the right side of the bucket extension 200. The bucket extension left side wall 206 may be positioned adjacent to the bucket left side wall 914 and the bucket extension right side wall 208 may be positioned adjacent to the bucket right side wall 916. The width of the bucket extension 200 may be less than the interior width of the bucket 910 such that the bucket extension 200 may fit within the interior of the bucket 910.

The bucket extension bottom wall 202 may comprise the pair of block capture posts. A left block capture post 212 may be located on the rear quarter of the left side of the bucket extension bottom wall 202 and a right block capture post 214 may be located on the rear quarter of the right side of the bucket extension bottom wall 202. The pair of block capture posts may be positioned to engage the hinge bottom apertures 248 in the hinge bottom halves 244 of the pair of mounting blocks. An individual block capture post 218 selected from the pair of block capture posts may be threaded such that the capture nut 216 screwed onto the individual block capture post 218 from above may hold the hinge 240 onto the individual block capture post 218. As a non-limiting example, the capture nut 216 may be a wing nut.

In use, the pair of mounting blocks may be coupled to the bucket 910. The block retention post 230 of the left mounting block 222 may pass through the left block mounting aperture on the bucket rear wall 912 and a retention nut 232 and a retention lock washer 234 may be screwed onto the block retention post 230 of the left mounting block 222. The block retention post 230 of the right mounting block 224 may pass through the right block mounting aperture on the bucket rear wall 912 and a retention nut 232 and a retention lock washer 234 may be screwed onto the block retention post 230 of the right mounting block 224. The bucket extension 200 may be coupled to the bucket 910 by sliding the bucket extension 200 into the bucket 910 such that the bucket extension bottom wall 202 slides to the rear of the bucket 910, passing under the pair of mounting blocks. The hinge bottom half 244 of the left mounting block 222 may be pivoted down such that the left block capture post 212 passes through the hinge bottom aperture 248 and a capture nut 216 may be screwed onto the left block capture post 212 to prevent the hinge bottom half 244 from lifting. The hinge bottom half 244 of the right mounting block 224 may be pivoted down such that the right block capture post 214 passes through the hinge bottom aperture 248 and a capture nut 216 may be screwed onto the right block capture post 214 to prevent the hinge bottom half 244 from lifting. The bucket extension 200 may be loaded with materials and the bucket 910 may be lifted so that the piece of equipment 900 may move the materials.

The bucket extension 200 may be removed by reversing the process stated above—remove the capture nuts 216, pivot the hinge bottom halves 244 up, slide the bucket extension 200 out from under the pair of mounting blocks and out of the bucket 910.

The exact specifications, materials used, and method of use of the bucket lifting extension device 100 may vary upon manufacturing. The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A bucket lifting extension attachment device configured for detachable coupling to a bucket of a piece of equipment, the device comprising:

a first mounting block and a second mounting block, wherein each of said first and second mounting blocks is adapted for attachment to a rear wall of the bucket, the first mounting block being positioned adjacent to a left side wall of the bucket and the second mounting block being positioned adjacent to a right side wall of the bucket, wherein each of the first and second mounting blocks includes a hinge mechanism featuring a pivoting hinge bottom half, enabling the hinge bottom half to pivot relative to a hinge top half connected to the mounting block; and, a bottom wall designed to slide into the gap defined beneath the first and second mounting blocks, and further including a first side wall and a second side wall extending upwards from the bottom wall to form a U-shaped structure, wherein the first side wall is positioned adjacent to the left side wall of the bucket and the second side wall is positioned adjacent to the right side wall of the bucket, thereby preventing materials from falling off the sides of the bucket extension when coupled to the bucket;

wherein the first and second mounting blocks are elevated above a bottom wall of the bucket to define a gap beneath the mounting blocks, the gap having a height sufficient to accommodate a bottom wall of a bucket extension, thereby allowing the bottom wall of the bucket extension to slide into the gap for coupling with the bucket;

wherein the bucket extension further comprises a first block capture post and a second block capture post, each positioned to engage with a corresponding hinge bottom half of the first and second mounting blocks respectively, enabling the bucket extension to be securely fastened to the bucket through a detachable engagement, facilitated by capture nuts that can be screwed onto the first and second block capture posts through the hinge bottom halves of the first and second mounting blocks, thus securing the bucket extension in place; and, wherein the device, through the aforementioned components and their configuration, enables the bucket of the piece of equipment to be enlarged for lifting bulky items, including but not limited to wood, mulch, construction materials, and farming materials, without affirmatively claiming the bucket as part of the invention, thereby enhancing the lifting and transporting capabilities of the bucket through a detachable, adaptable attachment that is specifically configured for compatibility with a range of equipment types, including skid steer loaders and tractors.

* * * * *